US007117549B1

(12) United States Patent
Hannigan

(10) Patent No.: US 7,117,549 B1
(45) Date of Patent: Oct. 10, 2006

(54) AUTOMATIC TOILET SEAT SANITIZER

(76) Inventor: Shayne T. Hannigan, 1058 Berme Rd., High Falls, NY (US) 12440

( * ) Notice: Subject to any disclaimer, the term of this patent is extended or adjusted under 35 U.S.C. 154(b) by 0 days.

(21) Appl. No.: 11/219,999

(22) Filed: Sep. 6, 2005

(51) Int. Cl.
*A47K 13/00* (2006.01)

(52) U.S. Cl. ..... 4/233

(58) Field of Classification Search ..... 4/233
See application file for complete search history.

(56) References Cited

U.S. PATENT DOCUMENTS

D130,780 S 12/1941 Shapiro
4,924,532 A 5/1990 Pennestri
4,953,238 A 9/1990 Shifferly
4,980,931 A 1/1991 Meisels
5,031,252 A 7/1991 Oyama
5,119,517 A 6/1992 Chang
5,806,105 A 9/1998 Yu
5,963,991 A * 10/1999 Agosti et al. ..... 4/233
6,003,159 A 12/1999 Sadegh et al.
6,289,526 B1 9/2001 Chang
2003/0046754 A1 3/2003 Pellati

* cited by examiner

*Primary Examiner*—Tuan Nguyen
(74) *Attorney, Agent, or Firm*—Lawrence J. Gibney, Jr.

(57) ABSTRACT

This is a device which will sanitize toilet water in one device. The sanitizer is placed over the existing toilet seat and securely fastened to the toilet bowl.

8 Claims, 5 Drawing Sheets

AUTOMATIC TOILET SEAT SANITIZER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

This relates to toilet seats in general and in particular a way to automatically sanitize and/or dry a toilet seat.

B. Prior Art

There are many other references to the prior art related to toilet seats and toilet seat sanitization as well as drying a toilet seat.

An example of this prior art is contained in Sadegh et al U.S. Pat. No. 6,003,159. Another example is Pellati publication US 2003/0046754.

However, none of the prior art combines the multiple functions of this particular device into one application.

BRIEF SUMMARY OF THE INVENTION

This is a toilet seat sanitization and drying unit, which is placed on the standard toilet bowl. In addition to providing the necessary cover for the water in the toilet bowl this seat sanitization device will freshen the air in the toilet bowl and dry the bowl area under the seat automatically.

It will be equipped with a seal to provide a tight fit during the sanitizing and drying process.

A light on the top of the device will indicate when the device is in use. Several control buttons including a heat control button, a fan control button, and a spray control button are positioned on the top of the seat for the convenience of the consumer.

On the underside of the lid will be a compartment wall which is located within the perimeter of the inside of the lid. A sanitizer container will be contained on the underside of the inside of the lid with a sanitizer tube which will direct the sanitizer to a spray nozzle, which is located on the underside of the toilet seat. A seal, which is placed around the perimeter of the bowl seals the toilet bowl area so that sanitization is complete and thorough.

A fan will allow fresh air and sanitized air to blow into the toilet bowl area to sanitize and freshen the air within the toilet bowl. The sanitizer container is designed to be disposal.

A protective compartment for the fan and the heating element is provided to prevent damage to the fan, fan blades and heating element.

In addition to providing forced air through the unit, there will also be a means to heat the air to help dry the air. The heating element will be positioned in close proximity to the fan for maximum effect.

It is an object of this invention to be able to sanitize a toilet seat by using forced air, a sanitizing mechanism as well as heat. It is also an object of this device to indicate to the user when the device can be used or when it is in use during the sanitation process to prevent accidental opening of the toilet bowl during operation.

DETAILED DESCRIPTION OF THE EMBODIMENT

Figure 1:
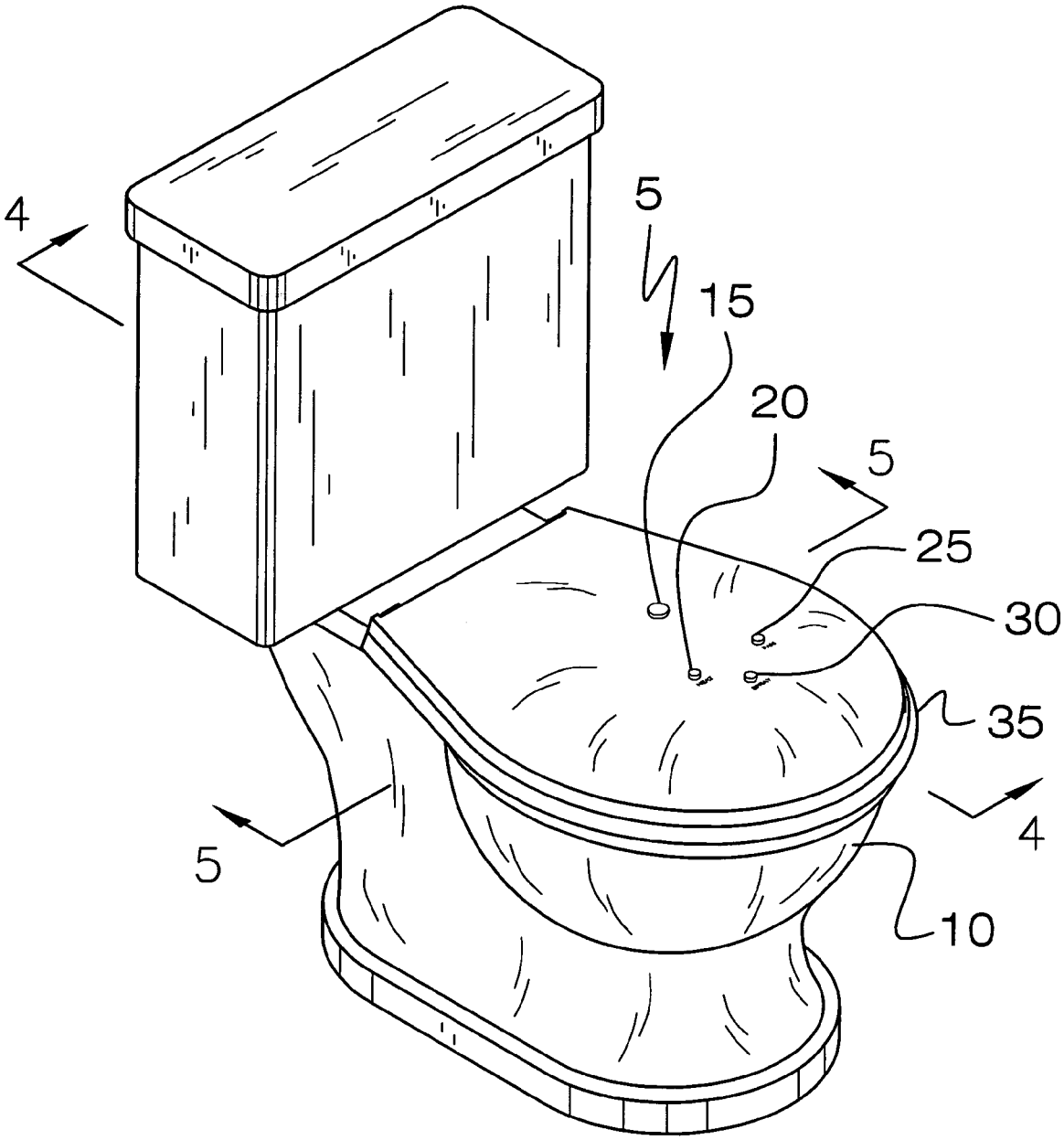
FIG. 1 is an isometric view of the device in the down position.

The seat sanitizer 5 is a device which will be placed over the opening of a standard toilet bowl 10. The standard toilet bowl 10 and toilet tank 12 are not claimed as part of this invention but are used in conjunction with this device. FIG. 1

The device will have the appearance of a normal looking seat but have special additional features. On the top surface will be a light 15 which will illuminate when the device is in use. Additionally, there will be several control buttons: heat control button 20, fan control button 25 and spray control button 30 on the top surface. These controls may be operated manually or may be adapted to operate automatically, particularly in areas of high usage. FIG. 1

A power source to operate the device including the light will likely be a plurality of batteries. All the equipment will be designed to require the minimum power usage to achieve maximum results. The power source and access to the power source is not shown in the drawings. Appropriate wiring will also be provided to ensure the proper electrical circuits. The means of access to the power source will be on the top surface for the convenience of the user.

Figure 4:
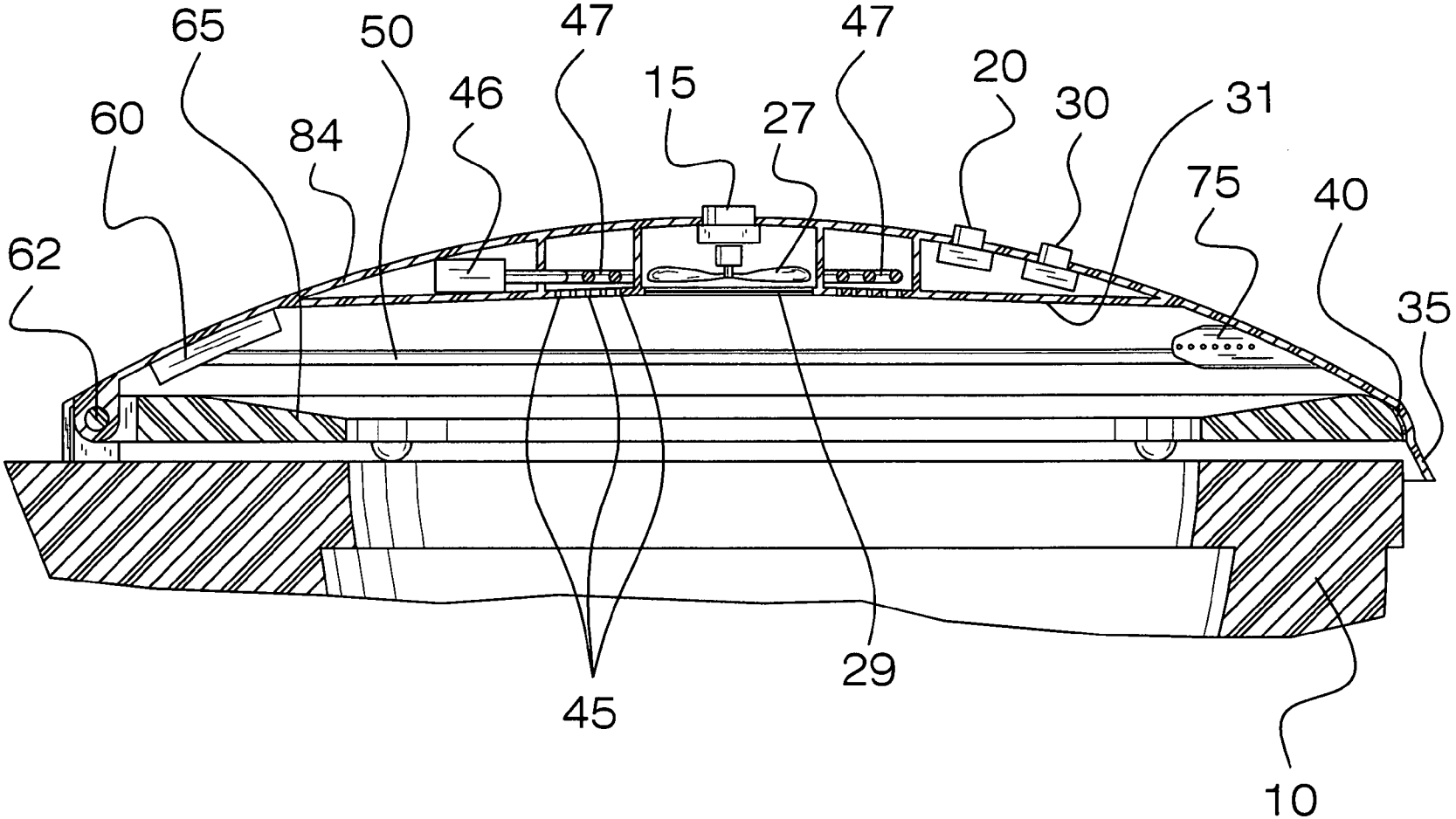
FIG. 4 is a view according to line 4—4 on FIG. 1.

A lip 35 on the device will insure the toilet bowl area is sealed during the sanitization and drying process to achieve maximum effect. FIGS. 1,4

On the underside of the seat sanitizer 5 will be a rubber seal 40 which will completely seal the area of the toilet seat 82 and toilet bowl 10. On the inside surface of the device will be a compartment wall 70 which will contain a fan 27. The compartment wall will protect the fan and heating module from damage. A fan grille 29 to protect the fan blades is also provided. FIG. 4

Figure 2:
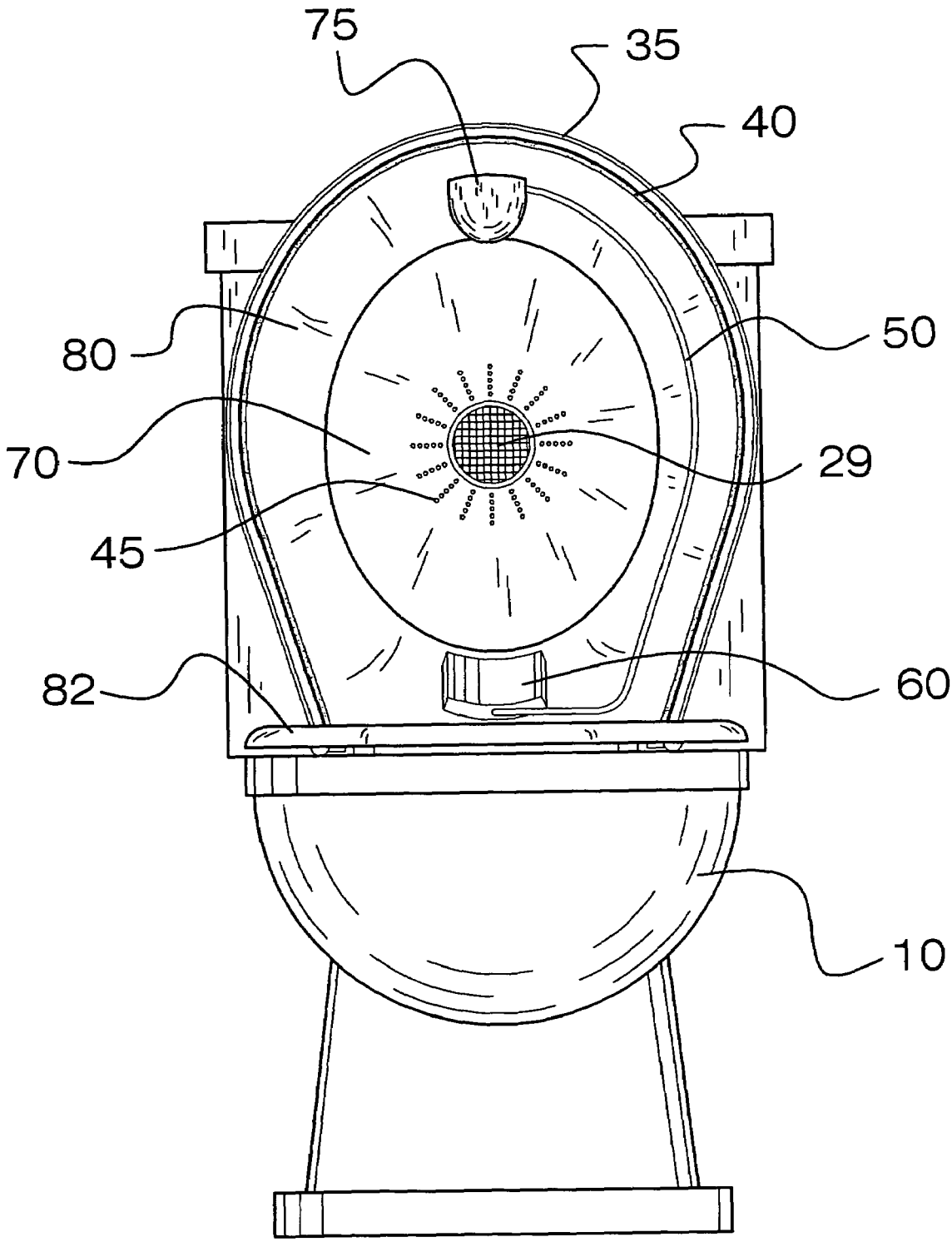
FIG. 2 is a front view of the underside of the device.
Figure 3:
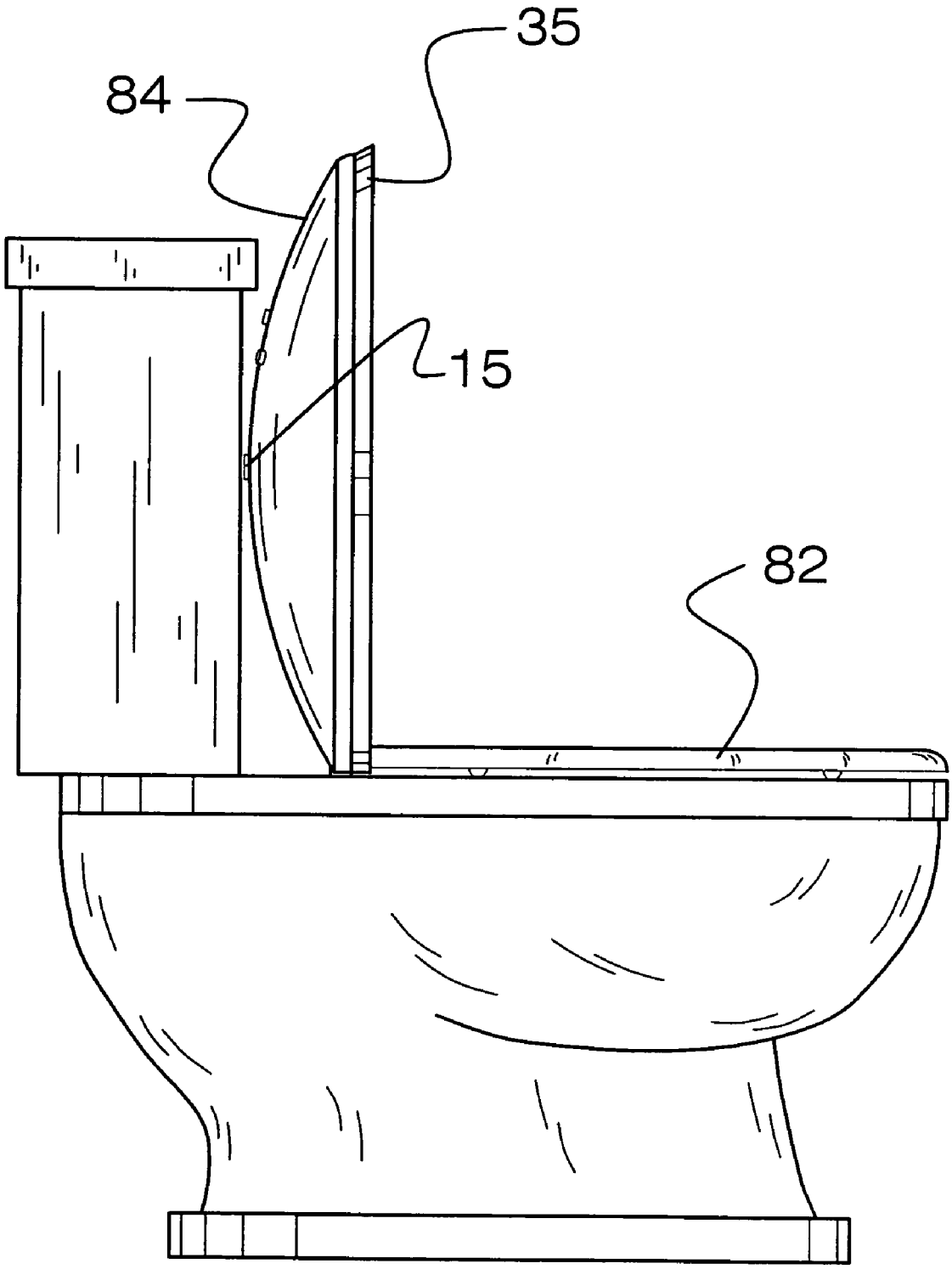
FIG. 3 is a side view of the device with the toilet seat and device in the up position.

An indicator light 15 on the top surface will illuminate when any of the functions of the device 5 are operational. FIGS. 2, 3 When the fan is operational, air will be directed through the fan grille 29 with appropriate air movement within the toilet bowl area.

In addition to the fan 27, there will also be a heating element 47 to heat the air, which is flowing into the toilet bowl area. The heating element 47 is contained between the top of the lid 35 and a compartment wall 31. The heating element 47 is controlled by a heating module 46 and a control button 20.

Figure 5:
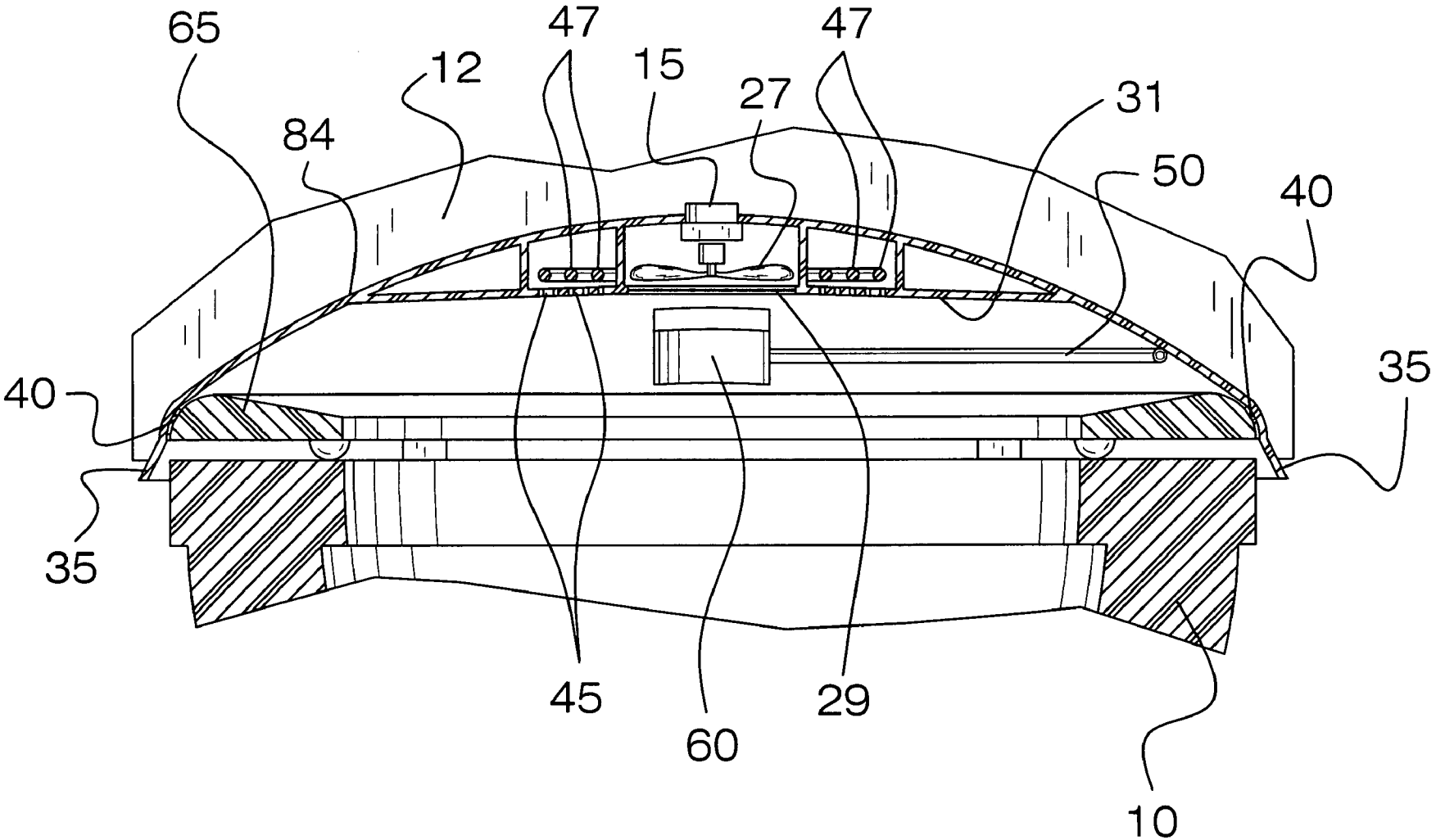
FIG. 5 is a view according to line 5—5 on FIG. 1.

When the heating element 47 is engaged this will heat the air to provide warm air in the event that it becomes necessary. A plurality of heater holes 45 are contained in the compartment wall 31 to direct the air downward into the toilet bowl area towards the water. FIGS. 2,4,5

The device will also be able to sanitize the air within the toilet bowl by using a sanitizer container 60, a sanitizer tube 50 and a spray nozzle 75. These elements are all contained on the underside of the lid 80. FIGS. 4,5 The spray nozzle 75, which will have a plurality of holes to achieve the desired spray, will be controlled by the spray control button 30, which is located on the top of the device and direct the spray into the toilet bowl. FIG. 4 The spray control button 30 will release a predetermined amount of spray through the tubing 50 and the spray nozzle 75 into the toilet bowl area. The sanitizer container 60 is designed to be disposable.

The device will be attached to the toilet seat using a bolt and a hinge 62, similar to the connection means for the standard toilet bowl. This means of connection will allow the device to rotate approximately ninety degrees to the completely open position. A rubber seal 40, which extends around the perimeter of the bowl, will help to prevent leakage from the toilet bowl 10 area. A lip 35, which extends downward around the device also helps to maximize the efficiency of this device for maximum effect. FIGS. 4, 5

The device 5 and its accessories may also be controlled with a timer to ensure the necessary frequency. The timer may control the time of operation and the duration of discharge. The timer may also allow automatically timed intervals for areas of high use.

The invention claimed is:

1. A device to sanitize and heat a toilet bowl which fits over a toilet bowl which is comprised of:

a. a top surface;

wherein the top surface covers the opening of the toilet bowl area;

wherein an indicator light is positioned on the top surface;

wherein a plurality of control buttons is placed on the top surface;

wherein a means of access to a power source is provided;

b. a bottom surface;

wherein a compartment wall is positioned on the bottom surface;

wherein a seal surrounds the perimeter;

c.

wherein the indicator light on the top surface is illuminated when the device is in use;

d. a fan;

wherein the fan is secured to the the underside of the top surface;

wherein the fan is contained in a protective compartment;

wherein the fan and fan blades are protected by a fan grille;

wherein the fan directs air towards the bowl area;

e. a fan control button;

wherein the fan control button is placed on the top surface of the device;

f. a sanitizer;

wherein the sanitizer container is positioned on the underside of the top surface;

wherein a means of connection for the sanitizer to the underside is provided;

wherein a sanitizer tube directs the sanitizer from the sanitizer to the container to a spray nozzle;

wherein a spray nozzle directs a sanitizing liquid to purify the air within the toilet bowl;

g. a sanitizer spray control button;

wherein the sanitizer spray control button is placed on the top surface of the device;

h. a heating module;

wherein the heating module is positioned on the underside of the top surface;

wherein the heating module is place in close proximity to the fan for maximum effect;

wherein a heating module is used to heat the air that is forced into the toilet bowl;

i. a heating module button;

wherein the heating module button is positioned on the top surface of the device;

j. a means of attachment;

wherein the means of attachment is a bolt;

k.

wherein a seal is provided around the perimeter of the inside surface of the device;

l.

wherein a lip is provided.

2. The seal as described in claim 1 is made from rubber.

3. The seal as described in claim 1 is made from neoprene.

4. The power source as described in claim 1 is a plurality of batteries.

5. The sanitizer as described in claim 1 is disposable.

6. The device as described in claim 1 wherein a timer is provided to control the operation.

7. The timer as described in claim 6 controls the the timing of the operation.

8. The timer as described in claim 6 controls the duration of the operation of the device.

* * * * *